United States Patent [19]

Cazes

[11] Patent Number: 5,047,105

[45] Date of Patent: Sep. 10, 1991

[54] PROCESS FOR FORMING THE BOTTOM OF A SACHET OF FLEXIBLE SYNTHETIC MATERIAL AND DEVICE FOR CARRYING OUT THE PROCESS

[75] Inventor: Michel Cazes, Vittel, France

[73] Assignee: Societe Generale Des Faux Minerals De Vittel, Vittel, France

[21] Appl. No.: 286,987

[22] PCT Filed: Feb. 9, 1988

[86] PCT No.: PCT/FR88/00070

§ 371 Date: Oct. 19, 1988

§ 102(e) Date: Oct. 19, 1988

[87] PCT Pub. No.: WO88/06125

PCT Pub. Date: Aug. 25, 1988

[30] Foreign Application Priority Data

Feb. 19, 1987 [FR] France ..... 87 02436

[51] Int. Cl.[5] ..... A63B 39/00; B32B 31/20

[52] U.S. Cl. ..... 156/146; 100/92; 100/214; 156/281; 156/308.4; 156/312; 156/536; 156/583.1; 156/598; 219/243

[58] Field of Search ..... 156/146, 312, 281, 536, 156/308.4, 583.1, 598; 219/243; 100/92, 214

[56] References Cited

FOREIGN PATENT DOCUMENTS 2079217 1/1982 United Kingdom ..... 156/583.1

*Primary Examiner*—John J. Gallagher
*Attorney, Agent, or Firm*—Weiser & Stapler

[57] ABSTRACT

Process for soldering the lower corners of a bag. Liquid is forced by the gradual moving together of two concave flasks (105, 106), of which the point of contact rises gradually towards the top with the relative moving together of the jaws (100, 101). Application to the conditioning of liquids.

14 Claims, 1 Drawing Sheet

1/1

100
101
102
103
104
105
106
107
108
109
110
111
112
113
114

PROCESS FOR FORMING THE BOTTOM OF A SACHET OF FLEXIBLE SYNTHETIC MATERIAL AND DEVICE FOR CARRYING OUT THE PROCESS

The present invention has for an object an improvement in the process for forming the bottom of a flexible sachet of flexible synthetic material starting from a cushion of synthetic material filled with liquid, for imparting an improved stability to the flexible sachet. The present invention also has for its object a device for carrying out such a process.

French Patent No. 83 18255, corresponding to European Patent No. 0142456, discloses a process in which a filled cushion is disposed on a support beam of a width less than the width of the cushion in such manner that the two lower corners of the cushion overhang the beam, depending downwardly. In applying a gripper to each side of the beam, the exerted grasping force expels the liquid contained in the two corners, and welds are produced along two lines to give stability to the sachet by forming two lugs corresponding to the corners.

Although this process gives full satisfaction, it has appeared that it is still possible to improve it.

In fact, when the jaws of the gripper come into application on the corners to expel the liquid contained therein, there is risk of sometimes obtaining an imperfect evacuation of the liquid, since the exerted force is exerted perpendicularly to the plane of the said corners.

In order to avoid this there is proposed, according to the present invention, a process in which the grippers each comprise a cheek piece having a convex surface which cooperates with a counter-abutment surface which is plane or itself constituted by an identical cheek piece, the said cheek pieces being articulated on the gripper in such manner that, in the advance of the latter towards the corner to be welded, the point of contact of the cheek piece on the corner of the sachet is displaced progressively upwards, in such manner as progressively to expel upwards the liquid contained in the said corner, that is to say towards the interior of the sachet.

The invention will be better understood with the aid of the description given below of a form of embodiment given by way of non-limitative example, with reference to the accompanying drawings wherein.

Figures 1, 2:
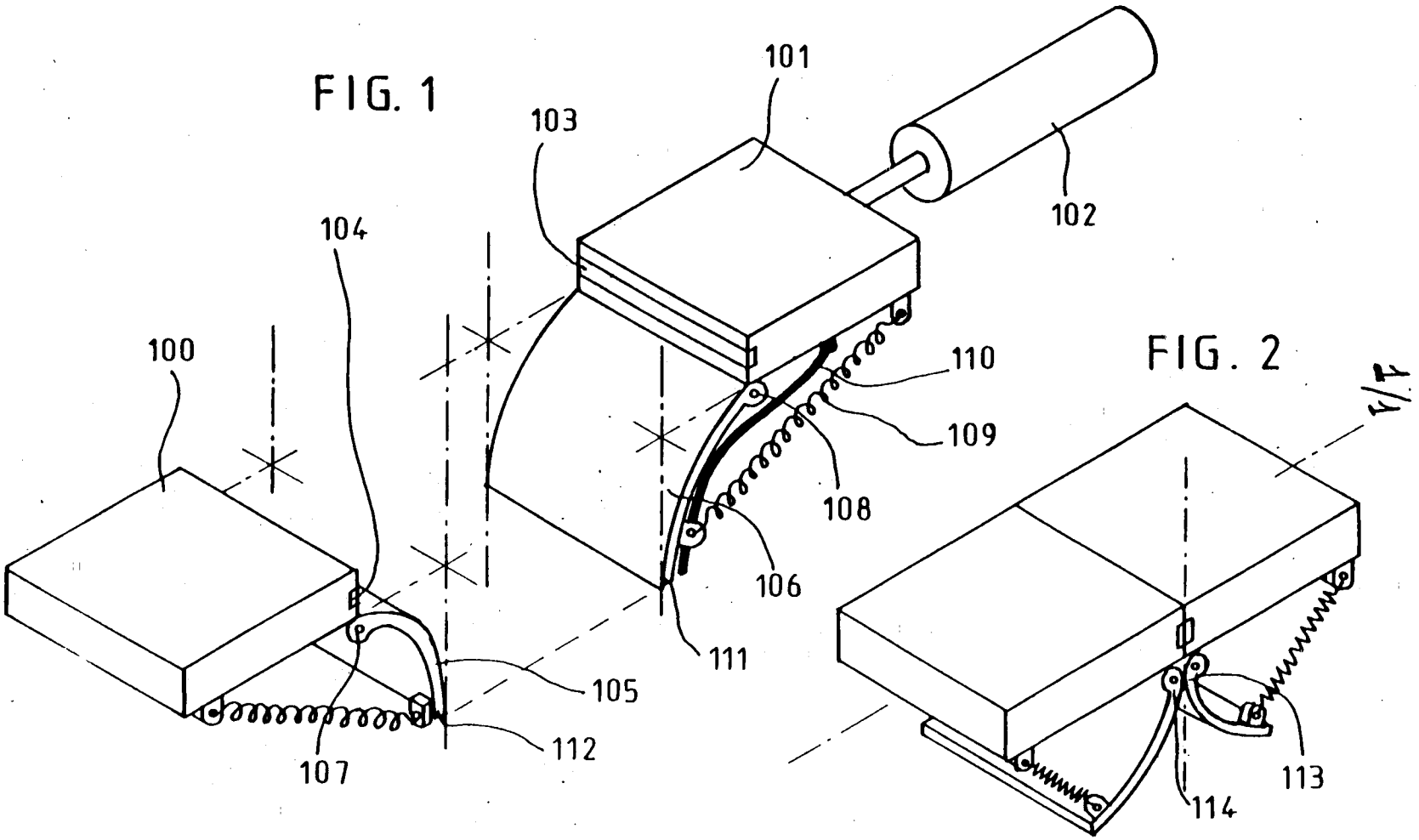
FIG. 1 is a perspective view of a gripper for carrying out the process according to the invention, at rest.
FIG. 2 is a view identical with that in FIG. 1, in the final welding position.

The device is composed for example of a pair of jaws (100, 101) translationally movable in a horizontal plane in relation to one another, for example under the action of cylinder-piston units such as (102).

On their front faces these jaws are equipped with welding means (103, 104) known per se, which will not be described in further detail.

On the lower face of each jaw there is attached a cheek piece (105, 106) rotatably articulated thereon about an axis (107, 108).

The cheek pieces are thrust by pressure tending to keep them protruding, in the direction towards one another, by an elastic means such as a spring (109) or a leaf spring (110).

In the carrying out of the process of the present invention, one corner of the sachet is disposed between the two cheek pieces and the jaws, respectively. At this stage it is filled with liquid.

In order to expel this liquid the two jaws are moved closer to one another, and then come into contact by the lower extremities (111, 112) of their respective cheek pieces. As the jaws (100, 101) approach one another, the point of contact between the cheek pieces rises, thus expelling the liquid from the inserted corner.

In the final position, as represented in FIG. 2, the cheek pieces are in contact by their upper extremities (113, 114). The liquid is totally expelled and the welding is effected by the jaws.

Of course a certain number of variants may be applied. Thus for example one of the jaws can comprise only a plane blade perpendicular to the horizontal plane of the jaws, the other jaw comprising a cheek piece as described above.

I claim:

1. A process for forming a lug in a sachet formed of a flexible synthetic material which contains a liquid, comprising the steps of:

disposing a lug-forming portion of a sachet between first and second opposing welding jaws, the first welding jaw including a convex-shaped cheek piece rotatably articulated thereon, and a counter-abutment surface extending from the second welding jaw, whereby the cheek piece yieldably protrudes from the first welding jaw toward the counter-abutment surface;

moving the welding jaws in relation to one another so that the lug-forming portion of the sachet is engaged between the cheek piece and the counter-abutment surface;

advancing the welding jaws toward each other so that the liquid in the portion of the sachet between the first cheekpiece and the counter-abutment surface is progressively displaced upwards by the urging of the lug-forming portion between the cheek piece and the counter-abutment surface;

expelling the liquid contained in the lug-forming portion of the sachet by the progressively upward displacement of the cheek piece; and forming a weld in said portion of the sachet when the opposing jaws come together, forming the lug in the sachet.

2. A process according to claim 1 wherein the portion of the sachet is welded together when the cheek piece and the counter-abutment surface have fully expelled all of the liquid from the portions of the sachet.

3. A process according to claim 1 wherein the counter-abutment surface is a second convex-shaped cheek piece rotatably articulated on the second welding jaw.

4. A process according to claim 1 wherein the liquid is expelled from the portion of the sachet by the progressively upward displacement of the point of contact of the cheek piece against a planar counter-abutment surface.

5. A process according to claim 1 which further comprises the step of urging the cheek piece outwardly to protrude from the first welding jaw.

6. A device for forming a lug in a sachet formed of a flexible synthetic materia which contains a liquid, comprising:

first and second welding jaws translationally movable in relation to one another and having opposing faces including means for welding portions of the sachet together;

a first cheek piece, having a convex curved surface, rotatably articulated on the face of the first welding jaw;

a counter-abutment surface extending from the face of the second welding jaw;

elastic means for causing the first cheek piece to protrude from the face of the first welding jaw toward the counter-abutment surface; and means for moving the jaws toward each other;

whereby, when a portion of a sachet to be formed into a lug is disposed between the jaws and the jaws are caused to move toward each other, the first cheek piece urges the portion of the sachet against the counter-abutment surface, and the liquid in the portion of the sachet is progressively moved upward by the urging of the sachet between the cheek piece and the counter-abutment surface.

7. A device according to claim 6 wherein the counter-abutment surface is a second convex-shaped cheek piece.

8. A device according to claim 7 wherein the second convex-shaped cheek piece is rotatably articulated on the second welding jaw.

9. A device according to claim 6 wherein the counter-abutment surface is a planar surface mounted to the second welding jaw.

10. A device according to claim 9 wherein the planar surface is perpendicularly mounted to the second welding jaw.

11. A device according to claim 6 wherein the means for moving the jaws toward each other is a cylinder-piston unit.

12. A device according to claim 6 wherein the elastic means is a spring.

13. A device according to claim 12 wherein the spring is a leaf spring.

14. A device according to claim 6 wherein the cheek piece has a curved surface which bows outwardly toward the counter-abutment surface.

* * * * *